United States Patent [19]

Brown et al.

[11] Patent Number: 5,049,948

[45] Date of Patent: Sep. 17, 1991

[54] COPY SHEET DE-REGISTRATION DEVICE

[75] Inventors: George B. Brown, Fairport; Dennis M. Ankrom, Williamson, both of N.Y.

[73] Assignee: Xerox Corporation, Stamford, Conn.

[21] Appl. No.: 288,491

[22] Filed: Dec. 22, 1988

[51] Int. Cl.[5] ..... G03G 15/00; B65H 9/16

[52] U.S. Cl. ..... 355/319; 271/251

[58] Field of Search ..... 355/317-320, 355/23-26, 309; 271/3.1, 248-252, 272-274, 225, 184, 902

[56] References Cited

U.S. PATENT DOCUMENTS

| | | | |
|---|---|---|---|
| 4,456,238 | 6/1984 | Mizuma | 271/3.1 |
| 4,480,825 | 11/1984 | Landa | 271/81 |
| 4,678,178 | 7/1987 | Akiyama et al. | 271/273 X |
| 4,712,786 | 12/1987 | Looney | 271/207 |
| 4,799,084 | 1/1989 | Koike et al. | 355/14 S H |
| 4,953,846 | 9/1990 | Azeta et al. | 271/151 |

FOREIGN PATENT DOCUMENTS

| | | | |
|---|---|---|---|
| 3113658 | 12/1982 | Fed. Rep. of Germany . | |
| 59-193471 | 11/1984 | Japan | 355/317 |
| 1-19364 | 1/1989 | Japan . | |

*Primary Examiner*—Joan H. Pendegrass
*Attorney, Agent, or Firm*—William A. Henry, II

[57] ABSTRACT

A copier/printer apparatus capable of duplex copying includes a roller assembly that shifts a sheet laterally while maintaining longitudinal movement of the sheet. A shaft that supports drive rolls that form nips with mating idler rolls has pins that extend into helical slots within the drive rolls such that the assembly rolls in a normal movement (axially) in one mode, while being able to have axial and lateral movement in another mode.

9 Claims, 2 Drawing Sheets

COPY SHEET DE-REGISTRATION DEVICE

This invention relates to a printer apparatus, and more particularly, to copy sheet de-registration device for use with such a printing apparatus in order to enhance the duplexing capability of the printing apparatus.

Duplexing of copy sheets requires registering each sheet to be duplexed against a side registration wall. In order to insure that the copy sheet is inboard of the registration edge in the duplex path a de-registration device is needed to de-register the simplexed copy sheet to the back of the printer within a limited amount of paper path distance and thereby permit a duplex registration system to drive the copy sheet into a registration wall in preparation for receiving a second image.

Prior art devices capable of moving sheets laterally include U.S. Pat. Nos. 4,712,786 and 4,480,825. In the '786 patent, a printing apparatus is disclosed that includes a sorter and an offsetting device. The offsetting device is positioned within the printer and is adapted to translate sheets en route to the sorter alternately front and rearward such that sheets are offset before they are driven into the sorter with subsequent sheet sets being offset from each other within bins of the sorter. An apparatus for separating sets of copy sheets from a copier is disclosed in the '825 patent that includes a mechanism that delivers alternate sets of sheets to a stationary tray along overlapping laterally spaced paths. Sheets are fed first through a transversely fixed assembly of opposing feed rollers and then through a second, transversely moveable assembly of feed rollers into a stacking tray. Sheets belonging to alternate sets are offset by shifting the second set of rollers laterally. A simpler and less costly means of offsetting sheets or sets is still needed for present day machines. The aforementioned patents are incorporated herein by reference to the extent necessary to practice the present invention.

Accordingly, a device is disclosed for de-registering sheets to the opposite edge of a machine in a duplex operation that uses pinch rolls with interior helical slots that drive the sheets sideways when the shaft on which the rolls are mounted is reversed. Forward rotation of the rolls transports the sheets normally without side shifting.

For a better understanding of the present invention, reference may be had to the accompanying drawings wherein the same reference numerals have been applied to like parts and wherein.

Figure 1:
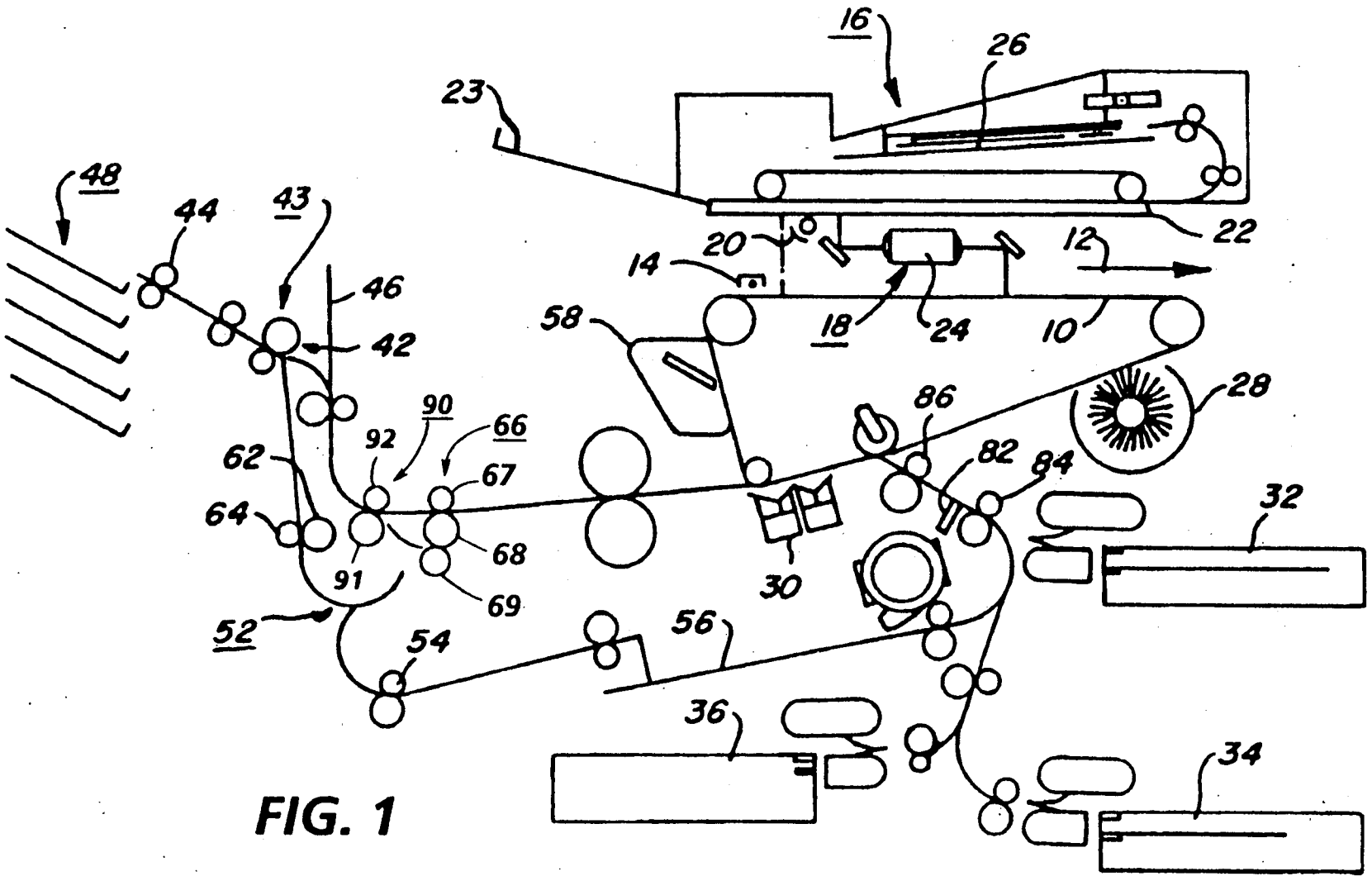
FIG. 1 is a schematic elevational view of a reproduction machine that employs the de-registration of the present invention.
Figure 2:
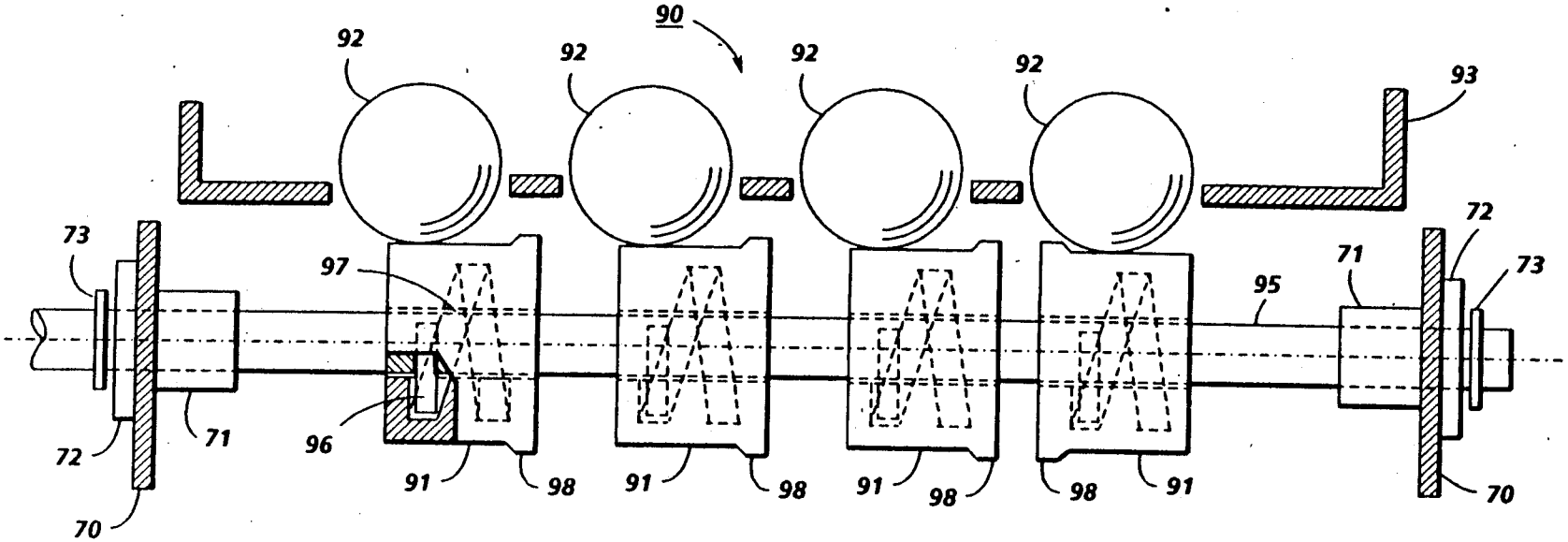
FIG. 2 is an exploded elevational view of a part of the paper path of the reproduction machine of FIG. 1 and includes the positional relationship of the de-registration device of the present invention within the machine paper path.

With reference to FIGS. 1 and 2, there is shown and electrophotographic printing or reproduction machine employing a belt 10 having a photoconductive surface. Belt 10 moves in the direction of arrow 12 to advance successive portions of the photoconductive surface through various processing stations, starting with a charging station including a corona generating device

14. The corona generating device charges the photoconductive surface to a relatively high substantially uniform potential.

The charged portion of the photoconductive surface is then advanced through an imaging station. At the imaging station, an automatic document feeder (ADF) 16 positions an original document face down over exposure system 18. The exposure system 18 includes lamp 20 illuminating the document positioned on transparent platen 22. The light rays reflected from the document are transmitted through lens 24. Lens 24 focuses the light image of the original document onto the charged portion of the photoconductive surface of belt 10 to selectively dissipate the charge. This records an electrostatic latent image onto the photoconductive surface corresponding to the information areas contained within the original document.

ADF 16 sequentially feeds documents from a holding tray 26, in seriatim, to platen 22. The document handling unit 16 drives the documents off platen 22 after imaging to a position where they are supported on tray 23. Thereafter, belt 10 advances the electrostatic latent image of each document recorded on the photoconductive surface to a development station.

At the development station a magnetic brush developer roller 28 advances a developer material into contact with the electrostatic latent image. The latent image attracts toner particles from the carrier granules of the developer material to form a toner powder image of the photoconductive surface of belt 10.

After the electrostatic latent image recorded on the photoconductive surface of belt 10 is developed, belt 10 advanced the toner powder image to the transfer station. At the transfer station a copy sheet is moved into contact with the toner powder image. The transfer station included a corona generating device 30 which sprays ions onto the backside of the copy sheet. This attracts the toner powder image from the photoconductive surface of belt 10 to the sheet.

The copy sheets are fed from a selected one of trays 32, 34 or 36 to the transfer station. After transfer, sheets are advanced to a fusing station. The fusing station includes a fuser assembly for permanently affixing the transferred powder image to the copy sheet. Preferably, fuser assembly 38 includes a heated fuser roller and backup roller with the sheet passing between fuser roller and backup roller.

After fusing, conveyor 40 transports the sheets to gate 42 which functions as an inverter selector. Depending upon the position of gate 42, the copy sheets will either be deflected into and through offsetting device 43 shown in U.S. Pat. No. 4,712,786 to sorter 48 through drive rolls 44 or driven up the transport 46. If a sheet is driven by drive roll 67 and idler roll 68 of inverter 66; onto transport 46, the trailing edge of the sheet upon passing de-registration device 90, drops into engagement with drive rollers 69. At this point, the sheet will be driven to gate 52. Decision gate 52 deflects the sheet directly into offsetting device 43 and sorter 48 in an inverted mode or deflects the sheets into a duplex inverter roll transport 54 to duplex tray 56. Duplex tray 56 provides intermediate or buffer storage for those sheets which have been printed on one side (simplexed) for printing on the opposite side (duplexed). In order to complete duplex copying, the previously simplexed sheets in tray 56 are fed in seriatim back to the transfer station for transfer of the toner powder image to the opposed side of the sheet and then transported though offsetting device 43 to sorter 48. Invariably, after the copy sheet is separated from the photoconductive surface of belt 10, some residual particles remain adhering to without skewing belt 10. These residual particles are removed from the photoconductive surface thereof at the cleaning station 58.

It is believed that the above description is sufficient for one to understand the general operation of the printing machine into which the present invention is incorporated. Now with particular reference to FIGS. 2 and 2A, a device 90 is disclosed for de-registering individual sheets as they pass through the device in a reverse direction before they reach duplexing 56. The advantages of such a de-registration device are numerous. For example, this device is passive, compact and low in cost.

Figure 2A:
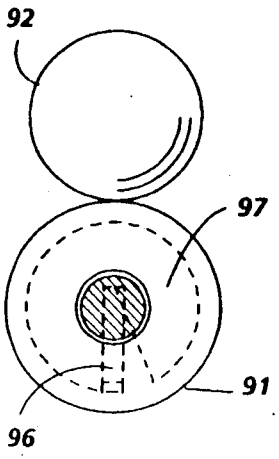
FIG. 2A is a side view of the de-registration of FIG. 2.

As seen in FIGS. 2 and 2A, a de-registration device 90 is shown that addresses the problem of how to enable duplex top/bottom registration. The device comprises a set of pinch rolls 91 and 92 that move a sheet of paper in the positive direction as shown by the arrow, i.e., toward the back of the machine or to the left of FIG. 2 so that the sheet can be registered by registration system 82, 84 and 86 for the next pass by transfer corotron 30. Copy sheets that are not to be duplexed are driven in the negative direction as shown by the arrow or toward the right as viewed in FIG. 2. A shaft 95 is supported by a housing 71 that is matingly connected to drive wheels 70 which in turn are held on the shaft by bushings 72 and screw members 73. Shaft 95 has perpendicular pins 96 that move within helical slots 97 that are located within drive rolls 91, when the shaft is rotated. As seen in FIGS. 2 and 2A, drive rolls 91 have a slightly larger radius than shaft 91. In the simplex mode, i.e., in the forward direction with the paper coming out of the figure as viewed in FIG. 2, the drive rolls are in their normal position. During the duplex mode, the drive rolls 91 are driven in a reverse direction and shift axially while the idler rolls 92 remain in their original position within their support structure 93. The drive rolls shift axially when the shaft reverses to drive the copy sheet into the duplex module 56. The shaft rotates relative to the drive rolls until the pins 96 bottom out in internal helical slots 97. This action shifts the rolls inboard along the drive shaft, shifting the copy sheet in the positive direction. When the shaft returns to forward rotation, the drive rolls reset to the outboard position or to the right as viewed in FIG. 2. As the copy sheet passes between the nip formed between Idler rolls 92 and drive rolls 91, it is corrugated by a protruding member 98 on a surface portion of each drive roll roller in order to increase the beam strength of the sheet and enhance control of the sheet.

It should be understood that the de-registration mechanism of the present invention could be used in any inversion system that uses a reversing roll to transport sheets in either a forward or reverse direction. In addition, the mechanism can be used to deskew copy sheets, by repositioning of the drive rolls by reverse rotation doing the intercopy gap time period.

It should now be apparent that a printing apparatus has been shown that includes a device for de-registering copy sheets away from a registration edge to the opposite side of a paper path so that predictable registration of the copy sheet can take place at a later time and place. The de-registration is accomplished by the use of unique pinch rolls with interior helical slots that drive the paper sideways when their support shaft is rotated in a reverse direction to the sheet feed direction. The drive rolls of the pinch rolls include a protruding portion that serves to corrugate the sheet as well.

What is claimed is:

1. In an apparatus capable of duplex copying, the improvement of de-registration of each copy sheet to the back of the apparatus within a limited amount of paper path distance so that each sheet can subsequently be registered against a registration wall before duplexing takes place, characterized by a set of pinch rolls that move each sheet toward the back of the apparatus, said pinch rolls being mounted on a shaft which has perpendicular pins therein that move within helical slots in drive rolls of the set of pinch rolls when said shaft is rotated, such that each sheet moving in a forward direction is unaffected and each sheet moving in a reverse direction with respect to the sheet feed direction is moved laterally.

2. The apparatus of claim 1, wherein said pinch rolls include drive rolls and idler rolls and wherein said drive rolls have protruding portions that serve to corrugate each sheet that passes through the rolls.

3. The apparatus of claim 2, wherein said drive rolls have an opening in their center that is larger than the outside diameter of said shaft.

4. In a printing apparatus adapted for printing copies of page image information onto copy sheets and feeding the copy sheets into a duplex tray for the printing of page image information onto their other sides, the improvement, comprising:

an offsetter device positioned within the printer and adapted to without skewing translate copy sheets en route to the duplex tray rearward with respect to the front of the printer in order to reposition the copy sheets for registration and feeding from the duplex tray, and wherein said offsetter device includes at least one set of pinch rolls that move each sheet toward the back of the apparatus, said at least one set of pinch rolls being mounted on a shaft which has perpendicular pins therein that move within helical slots in drive rolls of at least one set of pinch rolls when said shaft is rotated, such that each sheet moving in a forward direction is unaffected and each sheet moving in a reverse direction with respect to the sheet feed direction is moved laterally.

5. The apparatus of claim 4, wherein said pinch rolls include drive rolls and idler rolls and wherein said drive rolls have protruding portions that serve to corrugate each sheet that passes through the rolls.

6. The apparatus of claim 5, wherein said drive rolls have an opening in their center that is larger than the outside diameter of said shaft.

7. In a printing apparatus adapted for printing copies of page image information onto copy sheets and feeding the copy sheets into a duplex tray for the printing of page image information onto their other sides, the improvement, comprising:

an offsetter device positioned within the printer and adapted to without skewing translate copy sheets en route to the duplex tray rearward with respect to the front of the printer in order to reposition the copy sheets for registration and feeding from the duplex tray, and wherein said offsetter device includes at least one set of pinch rolls that move each sheet toward the back of the apparatus, said at least one set of pinch rolls being mounted on a shaft which has connecting radial pins that move within helical slots when said shaft is rotated, such that each sheet moving in a forward direction is unaffected and each sheet moving in a reverse direction with respect to the sheet feed direction is moved laterally.

8. In a printing apparatus adapted for printing copies of page image information onto copy sheets and feeding the copy sheets in a forward direction or in a reverse direction for feeding the sheets into a duplex path for the printing of page image information onto their other sides, the improvement, comprising:

an offsetter device adapted to translate copy sheets laterally en route to the duplex path in order to reposition the copy sheets for registration, including radial pins mounted on a feed roll shaft that move to a limited extent within helical slots when said shaft is rotated in said reverse direction.

9. The apparatus of claim 8, wherein said feed roll shaft has feed rolls thereon which translate said copy sheets only for said reverse direction of rotation of said shaft for said duplex path, and wherein said feed rolls are in the copy sheet output path of said printing apparatus.

* * * * *